US005715865A

United States Patent [19]

Wilke

[11] Patent Number: 5,715,865

[45] Date of Patent: Feb. 10, 1998

[54] PRESSURE COMPENSATING HYDRAULIC CONTROL VALVE SYSTEM

[75] Inventor: Raud A. Wilke, Dousman, Wis.

[73] Assignee: Husco International, Inc., Waukesha, Wis.

[21] Appl. No.: 747,843

[22] Filed: Nov. 13, 1996

[51] Int. Cl.[6] ..... F15B 13/08

[52] U.S. Cl. ..... 137/596; 60/427; 60/452; 91/446; 91/518; 91/531

[58] Field of Search ..... 60/427, 452; 91/446, 91/518, 531; 137/596

[56] References Cited

U.S. PATENT DOCUMENTS

| | | | |
|---|---|---|---|
| 3,881,512 | 5/1975 | Wilke | 91/446 X |
| 4,446,890 | 5/1984 | Simpson | 137/87 |
| 4,548,239 | 10/1985 | Eskildsen | 91/446 X |
| 4,693,272 | 9/1987 | Wilke | 137/596 |
| 4,736,770 | 4/1988 | Rousset et al. | 91/446 X |
| 5,025,625 | 6/1991 | Morikawa | 91/446 X |
| 5,036,750 | 8/1991 | Katayama | 91/464 |
| 5,038,671 | 8/1991 | Ueno | 91/446 X |
| 5,076,143 | 12/1991 | Ogawa | 91/420 |
| 5,113,894 | 5/1992 | Yoshida | 137/106 |
| 5,138,837 | 8/1992 | Obertrifter et al. | 91/446 X |
| 5,161,373 | 11/1992 | Morikawa et al. | 91/446 X |
| 5,222,426 | 6/1993 | Marcon et al. | 91/446 |
| 5,315,826 | 5/1994 | Hirata et al. | 91/446 X |
| 5,347,811 | 9/1994 | Hasegawa et al. | 60/426 |
| 5,400,816 | 3/1995 | Gerstenberger | 137/106 |
| 5,579,642 | 12/1996 | Wilke et al. | 91/446 X |
| 5,579,676 | 12/1996 | Wilke | 91/420 |

*Primary Examiner*—Gerald A. Michalsky
*Attorney, Agent, or Firm*—Quarles & Brady

[57] ABSTRACT

An improved pressure-compensated hydraulic system for feeding hydraulic fluid to one or more hydraulic actuators. A remotely located, variable displacement pump provides an output pressure equal to input pressure plus a constant margin. A pressure compensation systems requires that a load-dependent pressure be provided to the pump input through a load sense circuit. A reciprocally spooled, multi-ported isolator transmits the load-dependent pressure to the pump input but prevents fluid in the load sense circuit from leaving the load sense circuit and flowing through a relatively long conduit leading to the remotely located pump. In a multi-valve array, at least one valve section has a backflow-preventing shuttle valve which prevents backflow through the pressure compensation system if a main relief valve is operative.

15 Claims, 3 Drawing Sheets

PRESSURE COMPENSATING HYDRAULIC CONTROL VALVE SYSTEM

FIELD OF THE INVENTION

The present invention relates to valve assemblies which control hydraulically powered machinery; and more particularly to pressure compensated valves wherein a fixed differential pressure is to be maintained in order to maintain a uniform flow rate.

BACKGROUND

The speed of a hydraulically driven working member on a machine depends upon the cross-sectional area of principal narrowed orifices of the hydraulic system and the pressure drop across those orifices. To facilitate control, pressure compensating hydraulic control systems have been designed to eliminate the pressure drop. These previous control systems include sense lines which transmit the pressure at the valve workports to the input of a variable displacement hydraulic pump supplying pressurized hydraulic fluid in the system. The resulting self-adjustment of the pump output provides an approximately constant pressure drop across a control orifice whose cross-sectional area can be controlled by the machine operator. This facilitates control because, with the pressure drop held constant, the speed of movement of the working member is determined only by the cross-sectional area of the orifice. One such system is disclosed in U.S. Pat. No. 4,693,272 entitled "Post Pressure Compensated Unitary Hydraulic Valve", the disclosure of which is incorporated herein by reference.

Because the control valves and hydraulic pump in such a system normally are not immediately adjacent to each other, the changing load pressure information must be transmitted to the remote pump input through hoses or other conduits which can be relatively long. Some hydraulic fluid tends to drain out of these conduits while the machine is in a stopped, neutral state. When the operator again calls for motion, these conduits must refill before the pressure compensation system can be fully effective. Due to the length of these conduits, the response of the pump may lag, and a slight dipping of the loads can occur, which characteristics may be referred to as the "lag time" and "start-up dipping" problems.

In some types of hydraulic systems, the "bottoming out" of a piston driving a load could cause the entire system to "hang up". This could occur in such systems which used the greatest of the workport pressures to motivate the pressure compensation system. In that case, the bottomed out load has the greatest workport pressure and the pump is unable to provide a greater pressure; thus there would no longer be a pressure drop across the control orifice. As a remedy, such systems may include a pressure relief valve in a load sensing circuit of the hydraulic control system. In the bottomed out situation, the relief valve opens to drop the sensed pressure to the load sense relief pressure, enabling the pump to provide a pressure drop across the control orifice.

While this solution is effective, it could have an undesirable side effect in systems which use a pressure compensating check valve as part of the means of holding substantially constant the pressure drop across the control orifice. The pressure relief valve could open even when no piston was bottomed out if a workport pressure exceeded the set-point of the load sense relief valve. In that case, some fluid could flow from the workport backwards through the pressure compensating check valve into the pump chamber. As a result, the load could dip, which condition may be referred to as a "backflow" problem.

For the foregoing reasons, there is need for means to reduce or eliminate the problems of lag time, start-up dipping and backflow in some hydraulic systems.

SUMMARY OF THE INVENTION

The present invention is directed toward satisfying those needs.

A hydraulic valve assembly for feeding hydraulic fluid to at least one load includes a pump of the type which produces a variable output pressure which at any time is the sum of input pressure at a pump input port and a constant margin pressure. A separate valve section controlling the flow of hydraulic fluid from the pump to a hydraulic actuator connected to one of the loads and subjected to a load force that creates a load pressure. The valve sections are of a type in which the greatest load pressure is sensed to provide a load sense pressure which is transmitted to the control input port of the pump.

Each valve section has a metering orifice through which the hydraulic fluid passes from the pump to the respective actuator. Thus the output pressure of the pump is applied to one side of the metering orifice. A pressure compensating valve within each valve section provides the load sense pressure at the other side of the metering orifice, so that the pressure drop across the metering orifice is substantially equal to the constant amount. The pressure compensator has a poppet that slides within a bore and divides the bore into first and second chambers. The first chamber communicates with the other side of the metering orifice and the second chamber is in communication with the load sense pressure. As a result changes in a pressure differential between the first and second chambers causes movement of the poppet, where the magnitude and direction of that pressure differential determines a position of the poppet with in the bore.

The bore has an output port from which fluid is supplied to the respective hydraulic actuator. The poppet having a passage through which fluid can flow between the metering orifice and the output port with the amount of the flow governed by the position of the poppet. Such flow is enabled when pressure in the first chamber is greater than pressure in the second chamber and is disabled when the pressure in the second chamber is significantly greater than the pressure in the first chamber.

A check valve is located within the poppet and controls communication of pressure between the first chamber and one of the output port and the first second chamber. In one embodiment of the present invention, the check valve is in the passage of the poppet and closes that passage in response to pressure at the output port being greater than pressure in the first chamber, thereby preventing back flow of fluid from the actuaor to the pump under an excessive load pressure. In another embodiment of the present invention, the poppet has a pilot passage between the first and second chambers. Here the check valve closes the pilot passage in response to pressure in the second chamber being greater than pressure in the first chamber.

DETAILED DESCRIPTION OF A PREFERRED EMBODIMENT

Figure 1:
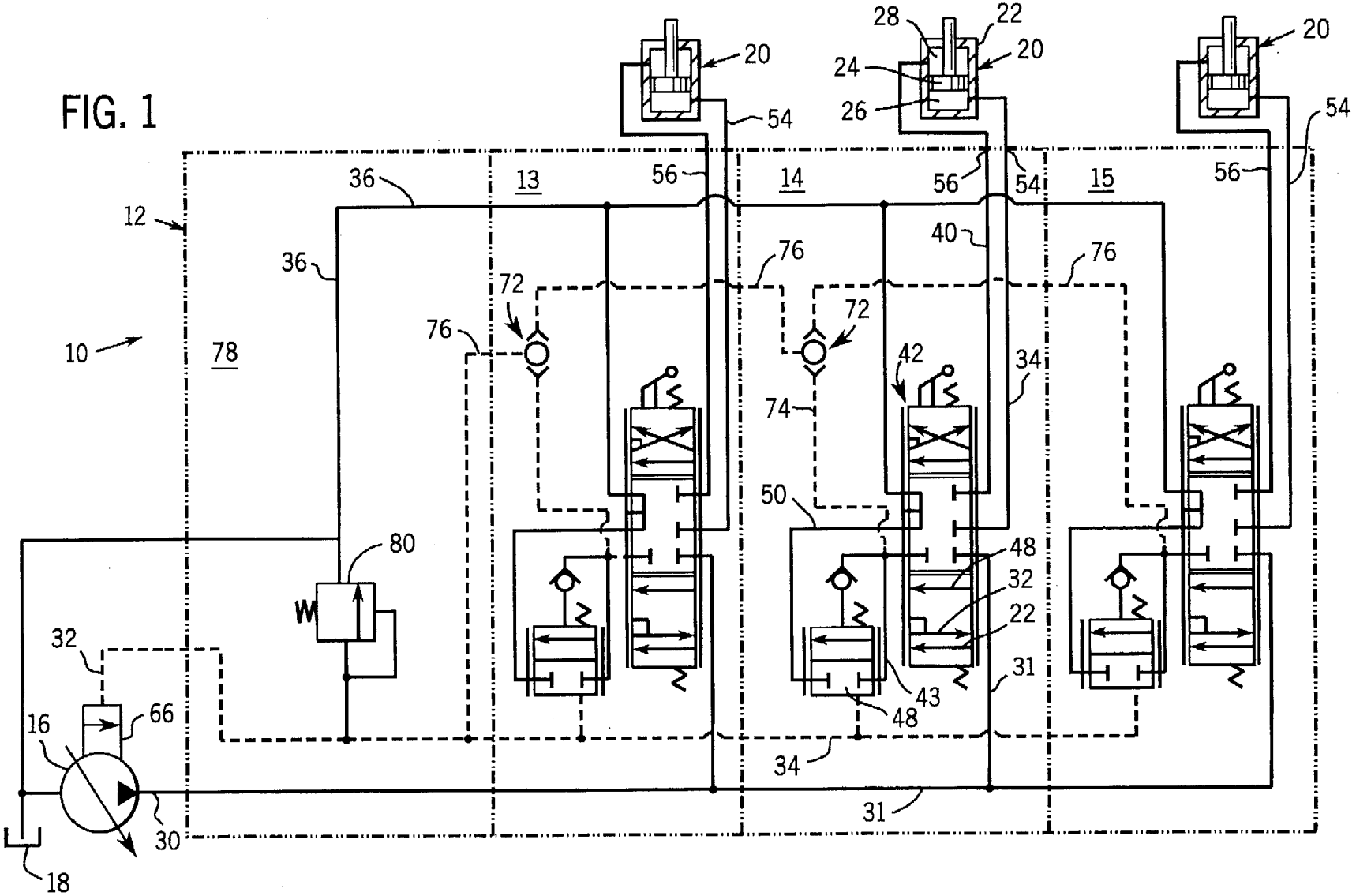
FIG. 1 a schematic diagram of a hydraulic system which incorporates a multiple valve assembly according to the present invention.

FIG. 1 schematically depicts a hydraulic system 10 having a multiple valve assembly 12 which controls all motions of hydraulically powered working members of a machine, such as the boom and bucket of a backhoe. The valve assembly 12 comprises of several individual valve sections 13, 14 and 15 interconnected side-by-side with each section used to control one degree of movement of the working members. A given valve section 13, 14 or 15 controls the flow of hydraulic fluid from a pump 16 to one of several actuators 20 connected to the working members and the return of the fluid to a reservoir or tank 18. Each actuator 20 has a cylinder housing 22 within which is a piston 24 that divides the housing interior into a bottom chamber 26 and a top chamber 28.

The pump 16 typically is located remotely from the valve assembly 12 and is connected by a supply conduit or hose 30 to a supply passage 31 extending through the valve assembly 12. The pump 16 is a variable displacement type whose output pressure is designed to be the sum of the pressure at a displacement control input port 32 plus a constant pressure, known as the "margin." The control input port 32 is connected to a transfer passage 34 that extends through the sections 13–15 of the valve assembly 12. A reservoir passage 36 also extends the valve assembly 12 and is coupled to the tank 18.

To facilitate understanding of the invention claimed herein, it is useful to describe basic fluid flow paths with respect to one of the valve sections 14 in the illustrated embodiment. Each of the valve sections 13–15 in the assembly 12 operates similarly, and the following description is applicable to each one.

Figure 2:
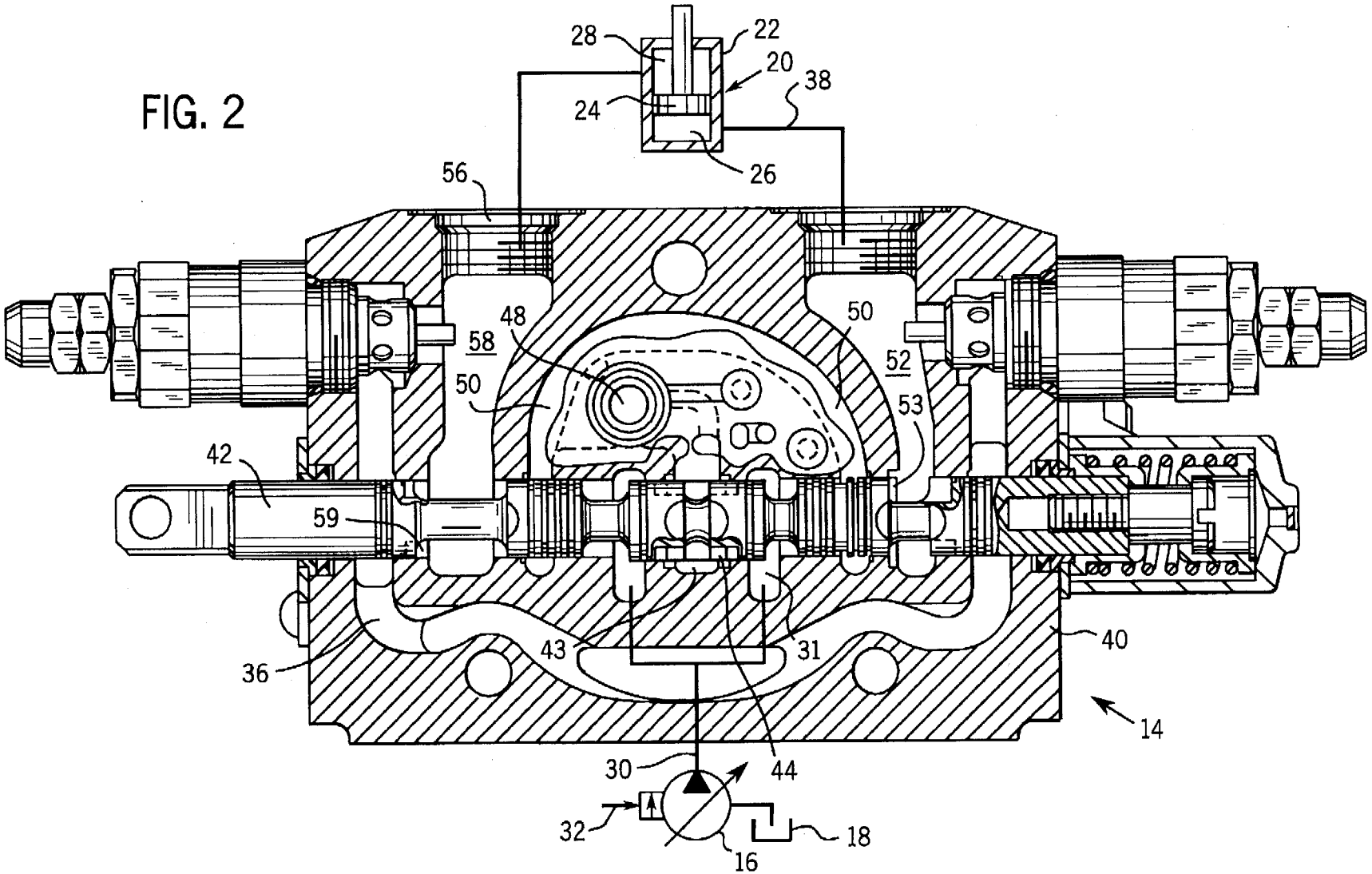
FIG. 2 is a partially schematic, partially sectional side-view of a valve which embodies the invention.

With additional reference to FIG. 2, the valve section 14 has a body 40 and control spool 42 which a machine operator can move in either reciprocal direction within a bore in the body by operating a control member which may be attached thereto, but which is not shown. Depending on which way the spool 42 is moved, hydraulic fluid, or oil, is directed to the bottom or top chamber 26 and 28 of a cylinder housing 22 and thereby drives the piston 24 up or down. References herein to directional relationships and movement, such as top and bottom or up and down, refer to the relationship and movement of the components in the orientation illustrated in the drawings, which may not be the orientation of the components in a particular application of the present invention. The extent to which the machine operator moves the control spool 42 determines the speed of the working member connected to the piston 24.

Figure 3:
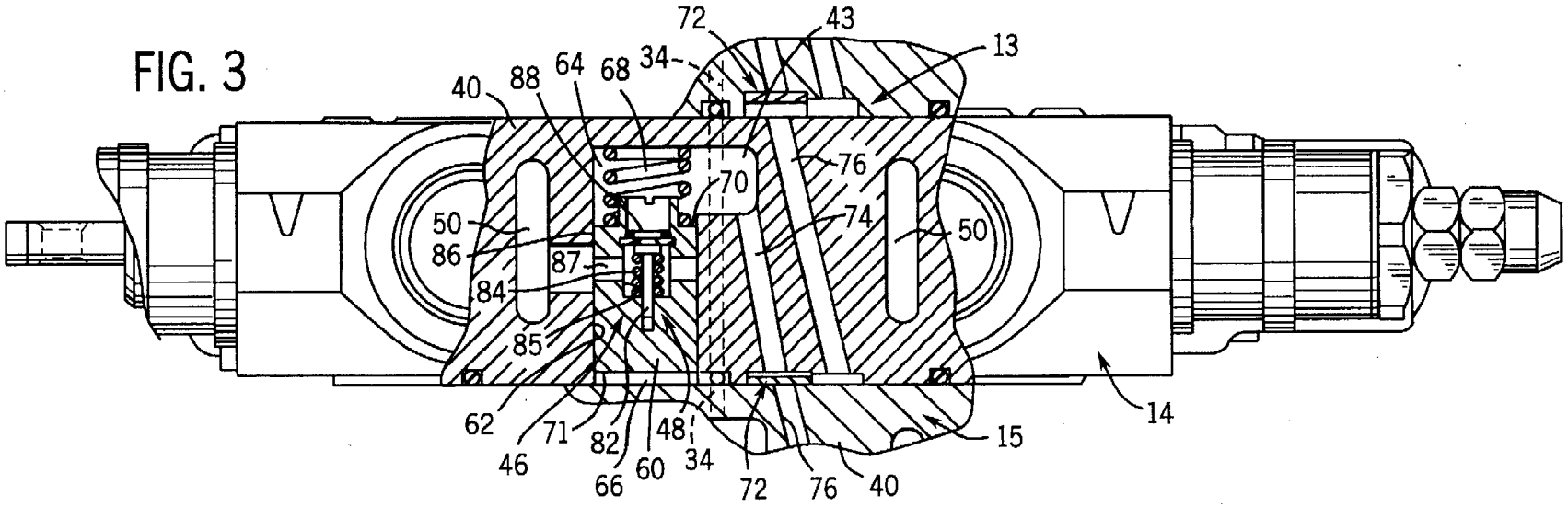
FIG. 3 is an orthogonal cross-sectional view of the valve in FIG. 2.

To raise the piston 24, the machine operator moves the reciprocal control spool 42 leftward. This opens passages which allows the pump 16 (under the control of the load sensing network to be described later) to draw hydraulic fluid from the reservoir 18 and force it to flow through pump output conduit 30, into a supply passage 31 in the body 40. From the supply passage 31 the fluid passes through a metering orifice formed by spool notch 44 of the control spool 42, through feeder passage 43 and through the variable orifice 46 (Figure 3) formed by a pressure compensating check valve 48. In the open state of the pressure compensating check valve 48, the hydraulic fluid travels through a bridge passage 50, a passage 53 of the control spool 42 and then through workport passage 52, out of work port 54 and into the bottom chamber 26 of the cylinder housing 22. The pressure thus transmitted to the bottom of the piston 24 causes it to move upward, which forces hydraulic fluid out of the top chamber 28 of the cylinder housing 22. This forced-out hydraulic fluid flows into workport 56, through the workport passage 58, the control spool 42 via passage 59 and the reservoir or tank passage 36 to the which is connected to the fluid tank 18.

To move the piston 24 downward, the machine operator moves control spool 42 rightward, which opens a corresponding set of passages so that the pump 16 forces hydraulic fluid into the top chamber 28, and out of the bottom chamber 26 of the cylinder housing 22, causing the piston 24 to move downward.

In the absence of a pressure compensation apparatus, the machine operator would have difficulty controlling the speed of the piston 24. The difficulty results from the speed of piston movement being directly related to the flow rate of the hydraulic fluid, which is determined primarily by two variables—the cross sectional areas of the most restrictive orifices in the flow path and the pressure drops across those orifices. The most restrictive orifice is the metering notch 44 of the control spool 42 and the operator is able to control the cross sectional area of the orifice by moving the control spool. Although this controls one variable which helps determine the flow rate, it provides less than optimum control because flow rate is also directly proportional to the square root of the total pressure drop in the system, which occurs primarily across spool notch 44. For example, adding material to the bucket of a backhoe might increase the pressure in the bottom cylinder chamber 26, which would reduce the difference between that load pressure and the pressure provided by the pump 16. Without pressure compensation, this reduction of the total pressure drop would reduce the flow rate and thereby reduce the speed of the piston 24 even if the machine operator holds metering notch 44 at a constant cross sectional area.

The present invention relates to a pressure compensation mechanism that is based upon the pressure compensating check valve 48 in each valve section 13–15. With primary reference to FIG. 3, the pressure compensating check valve 48 has a poppet 60 which sealingly slides reciprocally in a bore 62 in the valve body 40, dividing bore 62 into a first chamber 64, which is in communication with feeder passage 43, and a second chamber 66. The poppet 60 is biased downward (in the illustrated orientation) by a first spring 68 located in the first chamber 64. The top side 70 and a bottom side 71 of poppet 60 have equal areas. The poppet 60 has a central bore 85 with lateral apertures 87 which together form a path through the pressure compensating check valve 48 which is the variable orifice 46 referred to above.

The poppet 60 has an internal check valve within the central bore 85. The check valve comprises a valve member 82 biased by a second spring 84 into a closed state abutting an aperture ring 86. The aperture ring is held against a shoulder of the poppet bore by a snap ring 88 received within an annular groove in the bore. In order for the variable orifice path through the pressure compensating check valve 48 between first chamber 64 and bridge passage 50 to be open, the poppet 60 must be moved downward so that lateral apertures 87 communicate with bridge passage 50 and the check valve member 82 also must be open.

The pressure compensating mechanism senses the pressure at each powered workport of every valve section 13–15 in the multiple valve assembly 12, selects the greatest of these workport pressures to be applied to the displacement control input port 32 of the hydraulic pump 16. This selection is performed by a chain of shuttle valves 72, each of which is in a different valve section 13 and 14. The first valve section 15 in the chain need not have a shuttle valve (see FIG. 1). Referring the exemplary valve section 14 shown in FIGS. 1 and 3, the inputs to its shuttle valve 72 are (a) the feeder passage 43 (via shuttle passage 74) and (b) the through passage 76 of the upstream valve section 15 which has the powered workport pressures in the valves upstream from middle valve section 14. The feeder passage 43 sees the pressure of the powered one of workport 54 or 56, or the pressure of reservoir passage 36 when the spool 42 is in neutral. The shuttle valve 72 operates to transmit the greater of the pressures at inputs (a) and (b) via its section's through passage 76 to the shuttle valve 72 of the adjacent downstream valve section 13.

As shown in FIG. 1, the through-passage 76 of the farthest downstream valve section 13 in the chain of shuttle valves 72 opens into the transfer passage 34 which is connected to the pump control input port 32. Therefore, in the manner just described, the greatest of all the powered workport pressures in the valve assembly is transmitted to the control input port 32. The greatest of the powered workport pressures also is applied via the transfer passage 34 through each valve section 13–15 to second chamber 66 of pressure compensating check valves 48, thereby exerting that pressure on the bottom 71 of poppet 60.

An end section 78 of the valve assembly 12 contains ports for connecting the supply passage 31, transfer passage 34 and reservoir passage 36 to the pump 16 and the tank 18. This end section also includes a pressure relief valve 80 that relieves excessive pressure in the pump control transfer passage 34 to the tank 18.

In order for hydraulic fluid to flow from the pump to the powered workport 54 or 56, the variable orifice path through the pressure compensating check valve 48 must be at least partially open. For this to occur, the poppet 60 must be moved downward so that lateral apertures 87 communicate with the bridge passage 50. Because the areas of bottom 71 and top 70 sides of the poppet 60 are equal, fluid flow is throttled at orifice 46 so that the pressure in the first chamber 64 of compensation valve 48 is approximately equal to the greatest workport pressure in the second chamber 66. This pressure is communicated to one side of spool metering notch 44 via feeder passage 43 in FIG. 2. The other side of metering notch 44 is in communication with supply passage 31, which receives the pump output pressure that is equal to the greatest workport pressure plus the margin.

As a result, the pressure drop across the metering notch 44 is equal to the margin. Changes in the greatest workport pressure are seen both at the supply side (passage 31) of metering notch 44 and at the bottom side 71 of pressure compensating poppet 60. In reaction to such changes, the pressure compensating poppet 60 finds a balanced position so that the load sense margin is maintained across metering notch 44.

If the workport pressure at a particular valve section (e.g. 14) is greater than the supply pressure in feeder passage 43 in the load powered state, hydraulic fluid would be forced from the actuator 20 back through the pressure compensating check valve 48 to the pump outlet. The check valve member 82 inside the poppet 60 prevents this reverse flow from occuring by closing the path through the path through the pressure compensating check valve 48.

Therefore, the operation of the pressure compensating check valve 48 causes the pump margin pressure to be the approximately constant pressure drop across the metering notch 44.

Figure 4:
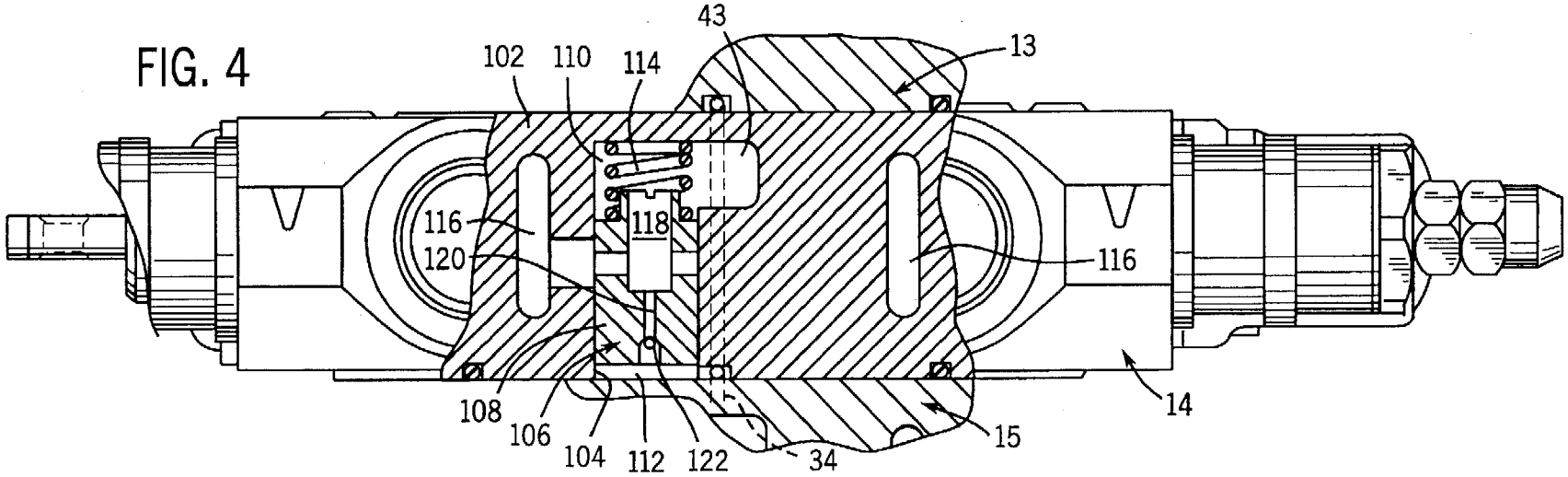
FIG. 4 is a cross sectional view that is similar to FIG. 3, but of another embodiment of the present invention.

FIG. 4 depicts another embodiment for achieving this result without employing a shuttle valve chain. Here a valve section 100 has the valve body 102 with a control spool (not shown) which operates in the same manner as described with respect to the previous embodiment with the feeder passage 43 from the control spool communicating with the first chamber 110 of the bore 104 of a pressure compensating check valve 106. The second chamber 112 of the valve bore 104 in turn communicates with the transfer passage 34 that leads to the control input port 32 of hydraulic pump 16.

The pressure compensating check valve 106 includes poppet 108 which sealingly slides reciprocally in the bore 104 and divides the bore into the first and second chambers 110 and 112. The top side and bottom sides of poppet 108 have equal areas. The poppet 108 is biased downward (in the illustrated orientation) by a first spring 114 located in the first chamber 110. As the poppet 108 moves downward, a path through a central poppet bore 118 is opened between first chamber 110 and a bridge passage 116, similar to bridge passage 50 in the first embodiment. This path is the variable orifice of the valve section as described previously.

A pilot passage 120 extends through the poppet 108 from the bottom surface to the internal bore 118 and a check valve 122 is formed in the pilot passage. The orientation of the check valve 122 is such that when the pressure in the internal bore 118 is the largest workport pressure of all the valve sections 13–15, the check valve 122 opens to apply that pressure to the transfer passage 34 and thus to the control input port 32 of the pump 16. However, the check valve 122 closes, as shown in FIG. 4, when the workport pressure of this valve section 14 is not the greatest workport pressure in the entire multiple valve assembly 12. This occurs when the pressure in the second bore chamber 112, received via transfer passage 34 from another valve section 13 or 15, is greater than the workport pressure in poppet bore 118 of this valve section 114.

Although preferred embodiments of the invention have been described above, the invention claimed is not so restricted. There may be various other modifications and changes to these embodiments which are within the scope of the invention. Thus, the invention is not to be limited by the specific description above, but should be judged by the claims which follow.

I claim:

1. In a hydraulic system having an array of valve sections for controlling flow of hydraulic fluid from a pump to a plurality of hydraulic actuators, each valve section having a workport to which one of the plurality of hydraulic actuators connects, the pump being of the type which produces an output pressure that is a constant amount greater than a pressure at a control input, the array of valve sections being of the type in which the greatest pressure among the workports is sensed to provide a load sense pressure which is transmitted to the control input; the improvement comprising:

within each valve section, a pressure compensating valve that provides the load sense pressure at one side of a metering orifice which sees on the other side the output pressure of the pump so that the pressure drop across the metering orifice is substantially equal to the constant amount, the pressure compensator having a poppet slidably located in a bore thereby defining first and second chambers of the bore, the first chamber being in communication with the metering orifice and the second chamber being in communication with the load sense pressure wherein a pressure differential between the first and second chambers determines a position of the poppet with in the bore, the bore having an output port through which fluid is supplied to one of the hydraulic actuators, the poppet having a passage through which fluid can flow between the metering orifice and the output port when the poppet is at a first position in response to pressure in the first chamber being greater than pressure in the second chamber; and a check valve within the poppet and controlling communication of pressure between the first chamber and one of the output port and the second chamber.

2. The hydraulic system as recited in claim 1 further comprising a pressure relief valve to which the greatest pressure among the workports is transmitted wherein the pressure at a control input is equal to the lower of (a) a set point pressure of the pressure relief valve and (b) the greatest pressure among the workports.

3. The hydraulic system as recited in claim 1 further comprising a spring located in the first chamber and biasing the poppet toward the first position.

4. A hydraulic valve mechanism for enabling an operator to control the flow of pressurized fluid in a fluid path from a variable displacement hydraulic pump to a hydraulic actuator which is subjected to a load force that creates a load pressure, the pump having a control input and producing an output pressure which is a constant amount greater than a pump input pressure, the hydraulic valve mechanism comprising:

(a) a first valve element and a second valve element juxtaposed to provide between them a metering orifice in the fluid path, at least one of the valve elements being movable under the control of the operator to vary the size of the metering office and thereby to control the flow of fluid to the hydraulic actuator;

(b) a sensor for sensing the load pressure at the hydraulic actuator and applying the load pressure to the control input of the pump;

(c) pressure compensator for maintaining across the metering orifice a pressure drop substantially equal to the constant amount, the pressure compensator having a poppet slidably located in a bore thereby defining first and second chambers of the bore on opposing sides of the poppet, the first chamber in being communication with the metering orifice and the second chamber being in communication with the load pressure sensed by the sensor wherein pressure differential between the first and second chambers determines a position of the poppet with in the bore, the bore having an output port through which fluid is supplied to the actuator, the poppet having a passage through which fluid can flow between the metering orifice and the output port when the poppet is at a first position in response to pressure in the first chamber being greater than pressure in the second chamber; and a check valve within the passage through the poppet and closing the passage in response to pressure at the output port being greater than pressure in the first chamber.

5. The hydraulic system as recited in claim 4 further comprising a spring located in the first chamber and biasing the poppet toward the first position.

6. A hydraulic valve mechanism for enabling an operator to control the flow of pressurized fluid in a fluid path from a variable displacement hydraulic pump to an hydraulic actuator subject to a load force which creates a load pressure, the pump having a control input and producing an output pressure which is a constant amount greater than the pump input pressure, the hydraulic valve mechanism comprising:

(a) a first valve element and a second valve element juxtaposed to provide between them a metering orifice in the fluid path, at least one of the valve elements being movable under the control of the operator to vary the size of the metering office and thereby to control the flow of fluid to the hydraulic actuator;

(b) a transfer passage for communicating the load pressure to the control input of the pump;

(c) pressure compensator for maintaining across the metering orifice a pressure drop substantially equal to the constant amount, the pressure compensator having a poppet slidably located in a bore thereby defining first and second chambers of the bore, the first chamber being in communication with the metering orifice and the second chamber being in communication with the transfer passage wherein pressure differential between the first and second chambers determines a position of the poppet with in the bore, the bore having an output port through which fluid is supplied to the actuator, the poppet having a passage through which fluid can flow between the metering orifice and the output port when the poppet is at a first position in response to pressure in the first chamber being greater than pressure in the second chamber, said poppet having a pilot passage between the first and second chambers; and a check valve within the pilot passage of the poppet and closing the pilot passage in response to pressure in the second chamber being greater than pressure in the first chamber.

7. The hydraulic system as recited in claim 6 further comprising a spring located in the first chamber and biasing the poppet toward the first position.

8. In a hydraulic system having an array of valve sections for controlling flow of hydraulic fluid from a pump to a plurality of hydraulic actuators, each valve section having a workport to which one of the plurality of hydraulic actuators connects, the pump being of the type which produces an output pressure that is a constant amount greater than a pressure at a control input, the array of valve sections being of the type in which the greatest pressure among the workports is sensed to provide a load sense pressure which is transmitted to the control input; the improvement within each valve section comprising:

a pressure compensating valve that provides the load sense pressure at one side of a metering orifice which sees on the other side the output pressure of the pump so that the pressure drop across the metering orifice is substantially equal to the constant amount, the pressure compensator having a poppet slidably located in a bore thereby defining first and second chambers of the bore, the first chamber being in communication with the metering orifice and the second chamber being in communication with the load sense pressure wherein a pressure differential between the first and second chambers determines a position of the poppet with in the bore, the bore having an output port through which fluid is supplied to one of the hydraulic actuators, the poppet having a passage through which fluid can flow between the metering orifice and the output port when the poppet is at a first position in response to pressure in the first chamber being greater than pressure in the second chamber; and a check valve within the passage of the poppet and closing the passage in response to pressure at the output port being greater than pressure in the first chamber.

9. The hydraulic system as recited in claim 8 further comprising a spring located in the first chamber and biasing the poppet toward the first position.

10. The hydraulic system as recited in claim 8 further comprising a chain of shuttle valves for selecting the greatest pressure among the workports of the hydraulic system.

11. The hydraulic system as recited in claim 8 wherein each valve section further comprises a shuttle valve having an output, a first input connected to the first chamber, and a second input connected the output of a shuttle valve in a different valve section of the hydraulic system.

12. The hydraulic system as recited in claim 8 further comprising a pressure relief valve to which the greatest pressure among the workports also is transmitted wherein the pressure at a control input is equal to the lower of (a) a set point pressure of the pressure relief valve and (b) the greatest workport pressure.

13. In a hydraulic system having an array of valve sections for controlling flow of hydraulic fluid from a pump to a plurality of hydraulic actuators, each valve section having a workport to which one of the plurality of hydraulic actuators connects, the pump being of the type which produces an output pressure that is a constant amount greater than a pressure at a control input, the array of valve sections being of the type in which the greatest pressure among the workports is sensed to provide a load sense pressure which is transmitted to the control input; the improvement within each valve section comprising:

a pressure compensating valve that provides the load sense pressure at one side of a metering orifice which sees on the other side the output pressure of the pump so that the pressure drop across the metering orifice is substantially equal to the constant amount, the pressure compensator including:

(a) a poppet slidably located in a bore thereby defining first and second chambers of the bore, the first chamber being in communication with the metering orifice and the second chamber being in communication with the control input of the pump wherein a pressure differential between the first and second chambers determines a position of the poppet with in the bore, the bore having an output port through which fluid is supplied to one of the hydraulic actuators, the poppet having a pilot passage between the first and second chambers; and (c) a check valve within the pilot passage of the poppet and closing the pilot passage in response to pressure in the second chamber being greater than pressure in the first chamber.

14. The hydraulic system as recited in claim 13 further comprising a pressure relief valve to which the greatest pressure among the workports also is transmitted wherein the pressure at a control input is equal to the lower of (a) a set point pressure of the pressure relief valve and (b) the greatest workport pressure.

15. The hydraulic system as recited in claim 13 further comprising a spring located in the first chamber and biasing the poppet toward the first position.

* * * * *